United States Patent [19]

Okamoto et al.

[11] Patent Number: 4,515,866

[45] Date of Patent: May 7, 1985

[54] FIBER-REINFORCED METALLIC COMPOSITE MATERIAL

[75] Inventors: Hideho Okamoto; Kohji Yamatsuta, both of Otsu; Ken-ichi Nishio, Shiga, all of Japan

[73] Assignee: Sumitomo Chemical Company, Limited, Osaka, Japan

[21] Appl. No.: 492,048

[22] Filed: May 6, 1983

Related U.S. Application Data

[63] Continuation-in-part of Ser. No. 364,515, Mar. 31, 1982, abandoned.

[30] Foreign Application Priority Data

Mar. 31, 1981 [JP] Japan ..... 56-49019

[51] Int. Cl.[3] ..... C22C 1/09; C22C 21/00

[52] U.S. Cl. ..... 428/614; 428/654; 501/87; 419/11; 419/14

[58] Field of Search ..... 428/614, 654; 106/65; 75/138

[56] References Cited

U.S. PATENT DOCUMENTS 3,596,344 8/1971 Kreider ..... 428/654
4,101,615 7/1978 Horikiri et al. ..... 106/65
4,152,149 5/1979 Horikiri et al. ..... 75/138

FOREIGN PATENT DOCUMENTS 2363636 3/1978 France .
52-7811 1/1977 Japan .
52-24111 1/1977 Japan .
56-16636 2/1981 Japan .
56-13780 3/1981 Japan ..... 428/614
1142083 2/1969 United Kingdom .

OTHER PUBLICATIONS

S. Yajima et al., Chemistry Letters, pp. 931–934, 1975.
Dr. Max Hansen, Constitution of Binary Alloys, McGraw Hill, pp. 927–932, 1958.

*Primary Examiner*—Veronica O'Keefe
*Attorney, Agent, or Firm*—Birch, Stewart, Kolasch & Birch

[57] ABSTRACT

A fiber-reinforced metal composite material comprising a reinforcing material and a matrix, said reinforcing material being inorganic fibers containing at least two components selected from carbon (as a simple substance), metal oxides, metal carbides, metal nitrides and metal borides, and said matrix being metal alloys containing zinc and aluminum, or zinc and magnesium as main component.

9 Claims, 8 Drawing Figures

10μm

10μm

10μm

10 μm

FIBER-REINFORCED METALLIC COMPOSITE MATERIAL

CROSS-REFERENCE TO RELATED APPLICATION

This application is a continuation-in-part application of Ser. No. 364,515 filed on Mar. 31, 1982, now abandoned.

BACKGROUND OF THE INVENTION

The present invention relates to a fiber-reinforced metallic composite material (hereinafter, referred to as "FRM"). More particularly, it relates to FRM which comprises a zinc/aluminum or zinc/magnesium alloy reinforced with an inorganic fiber containing two or more components selected from carbon (as a simple substance), metal oxides, metal carbides, metal nitrides and metal borides.

Recently, because of rapid technical development in many industrial fields such as aerospace, atomic power, automobiles and the like, there has occurred a strong demand for new materials of long life that are lighter in weight superior in mechanical properties such as strength, modulus of elasticity and the like as compared with the conventional materials mainly made of steel, and that are employable in high-temperature or low-temperature regions.

As one of the materials meeting such demand, there is proposed FRM which is produced by reinforcement of metals with inorganic fibers or whiskers of relatively small specific gravity, and active studies are made on the FRM. As the inorganic fibers or whiskers which are used as reinforcing materials for FRM, boron fibers, carbon or graphite fibers, alumina fibers, silicon carbide fibers, alumina whiskers and the like have so far been used.

These reinforcing fibers for FRM, however, have some drawbacks. For example, boron fibers are of high strength, but are poor in flexibility because of the large diameter, such as about 100 μm, and, therefore, are inferior in fabricability. Boron fibers are easy to react with practical metals such as aluminum, magnesium and the like, easily forming boron compounds at the fiber/-matrix interface at a relatively high temperature, which disadvantageously results in a reduction in FRM strength. Accordingly, the fiber surface is usually coated with silicon carbide or the like in order to inhibit the progress of this reaction. This method succeeds to some extent, but still has many drawbacks.

Carbon or graphite fibers are also of high strength and, high elasticity. However, they are easily oxidizable in air, and hence, when aluminum alloy is used as the matrix metal, brittle layers of $Al_4C_3$ are formed at the fiber/matrix interface, resulting in the strength reduction of the composite materials. Furthermore, carbon fibers cause an electrocorrosive reaction at the fiber/-matrix interface due to its good electrical conductivity, which results in a reduction in fiber strength. Carbon fibers, therefore, have a drawback in that they are easily corroded, for example by saline water.

Besides, carbon and liquid-phase aluminum are poor in wettability with each other. Consequently, for improving the wettability with matrix metals as well as inhibiting the foregoing reaction at the fiber/matrix interface, coating of carbon fiber surfaces with metals or ceramics is now actively studied with some degree of success. Carbon fibers, however, generally have a small diameter, such as less than 10 μm, and, therefore, it requires a higher level of coating technique and high cost to form uniform and even coatings on all the surfaces of a large number of the fibers. It can be said, therefore, that carbon fibers, in spite of their excellent properties, still have great problems to be solved for use as metal-reinforcing fibers.

Alumina or boron carbide whiskers are very high in both tensile strength and modulus of elasticity. But, mass production of whiskers of uniform diameter and length is difficult, which is the main reason for its high cost. When the alumina whisker is processed into composite materials together with metals, the foregoing drawback, i.e. reaction with matrix metals, is not observed since it has the structure of $\alpha$-$Al_2O_3$. But on the other hand, because of its poor wettability with matrix which facilitates the formation of porosity in the composite materials, the alumina whisker has a drawback of lowering the physical properties of the composite materials.

Metallic fibers such as stainless steel fibers, particularly those having an average diameter of 8 to 15 μm, are rich in flexibility. However, they have a specific gravity of about 8.0 g/cm$^3$ which is not useful in lightening the weight of FRM. Besides, when a molten alumina is used as matrix, it easily reacts with the fibers to cause a strength reduction of the composite materials.

Suitable kinds of matrix metals vary with the utility of FRM. For example, when weight-lightening is especially required, magnesium, aluminum or their alloys are mainly used, and when thermal resistance is especially required, copper, nickel, titanium or their alloys are mainly used. Among these matals, FRM that contains aluminum, magnesium or their alloys as a matrix metal is well studied and made on a trial basis.

The design of the bonding strength at the fiber/matrix metal interface is also an important factor to provide practical FRM. The bonding strength at the interface must be controlled to an optimum degree. One of the methods for obtaining such a state is surface treatment of the fiber, and the other method is to add a trace amount of other elements to the matrix to control the bonding strength. The former method, however, requires a considerable higher level of technique in ensuring uniform and even coatings on all the surfaces of a large number of fibers, and also involves a high cost. It is also very difficult to simultaneously control the bonding strength at the fiber/coating layer and coating layer/matrix metal interfaces formed by the surface treatment to an optimum degree. In the latter method wherein a trace amount of element is added, distribution of the added element in the vicinity of the fiber surface varies delicately depending upon the amount or kind of the element to be added, with which change the bonding strength at the fiber/matrix interface also changes. Thus, in these two methods, the bonding strength is not necessarily easily controlled, which causes difficulty in the quality control of FRM, especially in commercial scale production.

SUMMARY OF THE INVENTION

In order to solve the aforesaid various problems of the conventional FRM, the present inventors have intensively studied the combination of reinforcing inorganic fibers with metal matrixes. As a result, it has been found that in the case of a composite material comprising reinforcing inorganic fibers containing two or more of the compounds described below in the vicinity of their surface and a matrix metal of Zn-Al or Zn-Mg alloy, the bonding strength at the fiber/matrix interface can be controlled to an optimum degree, and that such a composite material is novel and has excellent mechanical properties as well as thermal resistance.

One object of the present invention is to provide a novel FRM which is (1) particularly superior in mechanical properties such as tensile strength, flexural strength, compressive strength, modulus of elasticity or fatique strength, and (2) exhibits a higher thermal resistance in high-temperature regions than fiber-reinforced resin composite materials as well as no brittleness in low-temperature regions. Another object of the invention is to provide a new combination system of fiber and matrix optimully controlled in the bonding strength at the fiber/matrix metal interface. A further object of the invention is to provide a new FRM which comprises a matrix metal alloy containing Zn-Al or Zn-Mg as main component which is reinforced by inorganic fibers containing at least two components selected from carbon (as a simple substance), metal oxides, metal carbides, metal nitrides and metal borides in the vicinity of the surface. These and other objects and advantages of the invention will be apparent to persons skilled in the art from the following description.

DETAILED DESCRIPTION

Figure 1:
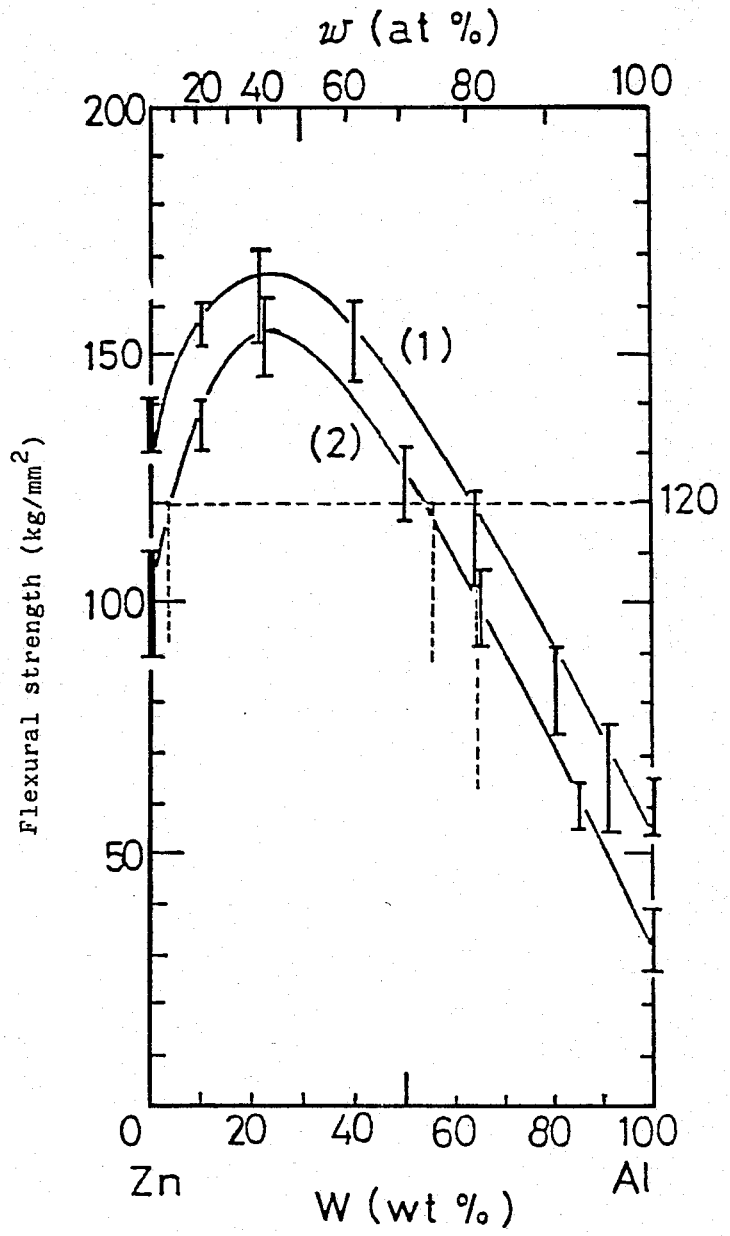
FIG. 1 is a plotting of the results of a bending test plotting the range of flexural strength versus aluminum content of the matrix.

The desired fiber-reinforced metal composite material of the present invention comprises a reinforcing material and a matrix, said reinforcing material being inorganic fibers containing at least two components selected from carbon (as a simple substance), metal oxides, metal carbides, metal nitrides and metal borides, and said matrix being metal alloys containing zinc and aluminum or zinc and magnesium as the main component.

In the present invention, it is important to specify the preferred combination of the inorganic fibers and the matrix metals. That is, in combinations in which the reaction at the fiber/matrix interface is markedly promoted at an elevated temperature (e.g. composite materials from a glass fibers such as E glass fibers and aluminum alloys), bonding strength at the interface is too strong, so that propagation of cracks becomes easy, which results in markedly lowering of the tensile strength, flexural strength, fatigue strength, and further impact strength of FRM produced. Consequently, such combinations should be avoided. On the other hand, combinations in which the reaction between fiber and matrix metal does not occur at all in high temperature regions (e.g. composite materials from $\alpha$-alumina fibers and zinc) are also undesirable, because the bonding strength at the fiber/matrix metal interface is extremely too weak to transmit stress between fibers via the matrix, which causes undesirable fracture of fiber preceding, induces pull-out of fibers, and results in strength reduction of FRM produced.

In order to overcome the foregoing drawbacks, it is considered to be necessary that the fracture mechanism of the composite materials be such that shear stress develops at the fiber/matrix interface to allow cracks to propagate along the interface. In this case, the bonding strength at the interface may be considered as being controlled neither too strong nor too weak but to an optimum degree.

The present inventors have found the following fundamental principle of preferred combination as a result of extensive study. That is, the outline of the fundamental principle of the combination which can give the desired FRM having excellent high strength of the present invention is as follows.

FRM is obtained by the combination of a reinforcing fiber having at least two components, $f_1$ and $f_2$, in the vicinity of its surface with a matrix metal alloy having at least two components, $m_1$ and $m_2$. Now, chemical reactivity at the fiber/matrix interface (interfacial reaction), $f_1/m_2$, $f_2/m_2$, $f_1/m_1$ and $f_2/m_1$ (the interface is expressed in a symbol, "/") will be considered.

It is disclosed in A. G. Metcalfe ed. "Interfaces in Metal Matrix Composites" (Composite Materials, Vol. 1), Academic Press (1974), Chap. 1 as follows:

1. An interface is the region of significantly changed chemical composition that constitutes the bond between the matrix and reinforcement (fiber).

2. There are three types in chemical reaction occuring between the filament and matrix, among which in Class I and Class II, filament and matrix are mutually nonreactive, and the examples of f/m are tungsten/copper, alumina/copper and alumina/silver (Class I), and carbon/nickel (Class II), and on the other hand, in Class III, for example, carbon/aluminum and silica/aluminum (>700° C.), filament and matrix are mutually reactive as shown in the following reaction schemes:

$$3C+4Al \rightarrow Al_4C_3$$

$$3SiO_2+4Al \rightarrow 2Al_2O_3+3Si$$

According to the above A. G. Metcalfe literature, the term "reactive" is restricted to those systems (=the filament and matrix) that result in the formation of a new chemical compound or compounds, and hence, the degree of reactivity can be defined by the change (plus or minus) of free energy ($\Delta G$) at a temperature T°K. in the following reaction:

$$f+m \rightleftharpoons f/m$$

$\Delta G$ is larger in minus, the reactivity is larger. In the present invention, when the $\Delta G$ is minus at a temperature of fabrication of FRM at f/m, the degree of reactivity at f/m is high, and when the $\Delta G$ is plus, the degree of reactivity at f/m is low.

Subject to simultaneously satisfy at least three conditions among four conditions of the degree of reactivity: high at $f_1/m_2$ and $f_2/m_2$, low at $f_1/m_1$ and $f_2/m_1$, by selecting the matrix so that it has a proper content ratio of $m_1$ and $m_2$ to a given fiber having two components, $f_1$ and $f_2$, since the bonding strength at $(f_1+f_2)/(m_1+m_2)$ depends on the degree of the above interfacial reaction, the tensile strength, flexural strength, fatigue strength, impact strength and the like of FRM produced can be maximum.

However, even if one of the foregoing four conditions is not satisfied, if the other three conditions are satisfied simultaneously, the bonding strength at the fiber/matrix metal interface can be controlled to an optimum degree to obtain the above effect of this invention.

Five cases as shown in the following table are the case which satisfies simultaneously three conditions among the four conditions wherein the degree of reactivity is high at $f_1/m_2$ and $f_2/m_2$ and is low at $f_1/m_1$ and $f_2/m_1$.

| Chemical reactivity | Cases I | II | III | IV | V |
|---|---|---|---|---|---|
| High | $f_1/m_2$<br>$f_2/m_2$ | $f_2/m_2$ | $f_1/m_2$ | $f_1/m_2$<br>$f_2/m_2$<br>$f_1/m_1$ | $f_1/m_2$<br>$f_2/m_2$<br>$f_2/m_1$ |
| Low | $f_1/m_1$<br>$f_2/m_1$ | $f_1/m_2$<br>$f_1/m_1$<br>$f_2/m_1$ | $f_1/m_2$<br>$f_1/m_1$<br>$f_2/m_1$ | $f_1/m_1$ | $f_1/m_1$ |

Consequently, the description above means that a combination of $(f_1+f_2)$ fiber with $(m_1+m_2)$ matrix is superior to a combination of $(f_1+f_2)$ fiber with $m_1$ matrix or $m_2$ matrix or a combination of $f_1$ fiber with $(m_1+m_2)$ matrix or $f_2$ fiber with $(m_1+m_2)$ matrix. In this case, the complexing effect as a FRM is successfully accomplished.

The matrix components used in this invention are such that $m_1$ is Zn and $m_2$ is Al or Mg from the standpoint of practical alloy.

The inorganic fibers or whiskers used as the reinforcing material in the present invention include all materials which contain, as the main component, two or more components selected from carbon (C) (as a simple substance), metal oxides (e.g. $Al_2O_3$, $SiO_2$, $ZrO_2$), metal carbides (e.g. SiC, TiC), metal nitrides (e.g. $Si_3N_4$) and metal borides (e.g. $TiB_2$) in the vicinity of their surface. Thus inorganic fibers such as carbon fibers, graphite fibers, metallic fibers and the like, the surface of which has been coated with the foregoing components, can also be used in the present invention. The fibers are preferably in the form of a long or continuous fiber. Particularly suitable examples of the inorganic fibers or whiskers are alumina-silica fibers and free carbon-containing silicon carbide fibers because they are capable of exhibiting a remarkable metal reinforcing effect on a Zn/Al or Zn/Mg binary alloy matrix, thereby producing high-strength FRM from said matrix, and also, because they are producible on a commercial scale.

The alumina-silica fibers used in the present invention are of such a composition that the alumina ($Al_2O_3$) content is in the rage of 72 to 98% by weight, preferably 75 to 98% by weight and the silica ($SiO_2$) content is in the range of 2 to 28% by weight, preferably 2 to 25% by weight.

Silica may be replaced by the following oxides within the range of not more than 10 wt.%, preferably not more than 5 wt.%, based on the total weight of the fiber: oxides of one or more elements selected from lithium, beryllium, boron, sodium, magnesium, phosphorus, potassium, calcium, titanium, chromium, manganese, yttrium, zirconium, lanthanum, tungsten and barium.

Preferably, the alumina-silica fiber is such that it exhibits substantially no reflection due to the $\alpha$-$Al_2O_3$ structure by X-ray diffraction. Generally, the following phenomenon is observed in inorganic fibers. That is, the crystalline grains of inorganic substances forming the fiber grow at an elevated temperature to fracture the crystalline boundary, whereby the fiber strength is markedly lowered. In case of alumina-silica fibers, according to the inventors' investigation, this phenomenon is characterized in that reflection due to the $\alpha$-alumina structure appears in the X-ray diffraction pattern. The alumina-silica fiber used in the present invention, therefore, should be a fiber produced so as not to exhibit such reflection in the pattern.

According to the inventor's discovery, such an alumina-silica fiber has excellent properties as a reinforcing fiber, as described below. It has a high tensile strength as more than 10 t/cm$^2$ and a high Young's modulus as more than 1,000 t/cm$^2$; it is made of stable oxides so that it shows no deterioration even by prolonged exposure to a high temperature such as more than 1000° C. in air; and its density is as light as 2.5 to 3.5 g/cm$^3$. These performances depend upon the silica content of the fiber, but according to the inventor's discovery, they develop to a maximum at a silica content of 2 to 28% by weight, preferably 2 to 25% by weight.

The alumina-silica fiber described above can be produced by various methods, for example, by a method involving spinning a viscous solution containing an aluminum compound (e.g. alumina sols, aluminum salts), a silicon compound (e.g. silica sols, ethyl silicate) and an organic high polymer (e.g. polyethylene oxide, polyvinyl alcohol) into a precursor fiber and calcining it in air at a temperature below that at which reflection due to the -alumina structure becomes visible in the X-ray diffraction pattern. Alternatively, said fiber may also be produced by soaking an organic fiber in a solution containing an aluminum compound and a silicon compound, followed by calcination in air. The most preferred alumina-silica fiber is produced by the method disclosed in Japanese Patent Publication No. 13768/1976 and U.S. Pat. No. 4,101,615, i.e. by a method involving spinning a solution containing polyaluminoxane and a silicon compound into a precursor fiber, followed by calcination in air. Polyaluminoxane as used herein is a polymer having a structural unit of the formula:

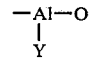

wherein Y comprises one or more selected from the following residues: alkyl groups such as methyl, ethyl, propyl, butyl and etc., alkoxy groups such as ethoxy, propoxy, butoxy and etc., carboxyl groups such as formyloxy, acetoxy and etc., halogen such as fluorine, chlorine and etc., and phenoxy groups.

Polyaluminoxane is obtained by partial hydrolysis of organoaluminum compounds such as triethyl aluminum, triisopropyl aluminum, tributyl aluminum, aluminum triethoxide, aluminum tributoxide and the like, or by replacing the organic residue of polyaluminoxane obtained with other proper residue.

Polyaluminoxane, in general, is soluble in organic solvents such as diethyl ether, tetrahydrofuran, benzene and toluene, turning viscous solution which is rich in spinnability at proper concentrations.

As the silicon-containing compound to be mixed, polyorganosiloxane having a structural unit of the formula:

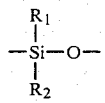

(in which $R_1$ and $R_2$ are an organic group) and polysilicic acid esters having a structural unit of the formula:

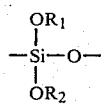

(in which $R_1$ and $R_2$ are as defined above) are preferably used. Besides, organosilane of the formula: $R_nSiX_{4-n}$ [wherein X is OH or OR (in which R is an organic group) and n is an integer of not more than 4], silicic acid esters of the formula: $Si(OR)_4$ (in which R is an organic group) and other silicon-containing compounds may also be used.

In some cases, it is effective to mix two or more of silicon-containing compounds with the polyaluminoxane solution.

Further, it is desirable to add to the spinning solution a small amount of one or more of compounds containing the following elements in order to improve the physical properties of the alumina-silica fiber obtained: lithium, beryllium, boron, sodium, magnesium, phosphorus, potassium, calcium, titanium, chromium, manganese, yttrium, zirconium, lanthanum, tungsten and the like.

For spinning a mixed solution of polyaluminoxane and a silicon-containing compound, the so-called dry spinning method is favorable, but other suitable methods such as centrifugal spinning, blow spinning and the like may also be applied. Spinning is carried out at room temperature, but if necessary, the spinning solution may be heated. It is also desirable to regulate the atmosphere around the spun fibers in order to obtain good results. Although solvent removal from the spun fibers by drying is not particularly necessary in case of fine fibers, it may be carried out during or after spinning.

The average diameter of the precursor fiber thus obtained is generally within the range of 1 to 600 μm.

The alumina-silica precursor fiber thus obtained is in such a state that alumina-rich components, which form alumina after calcination, have been joined together uniformly, continuously and in high concentrations to take a fibrous form, which is therefore very advantageous for improvement in the physical properties of the alumina-silica fiber after calcination.

The alumina-silica precursor fiber thus obtained will not melt upon heating, and it may easily be turned into alumina-silica fiber without deformation of its form by calcination in an oxygen-containing atmosphere such as air. That is, upon calcination in an oxygen-containing atmosphere such as air, the precursor fiber changes at about 700° C. into substantial alumina-silica fiber which further turns transparent, high-strength alumina-silica fiber at about 1000° C. to 1200° C. For obtaining various types of alumina-silica fibers, said precursor fiber may be calcined in an inert atmosphere such as nitrogen or in vacuum and then exposed to an oxygen-containing atmosphere to remove organic matters or carbon matters. Also, additional calcination of the obtained alumina-silica fiber in a reductive atmosphere such as hydrogen is desirable to improve the physical properties of the fiber. Furthermore, application of tension to the precursor fiber or alumina-silica fiber during the calcination is desirable to produce strong alumina-silica fiber.

In any case, the highest calcination temperature should be set so that reflection due to the α-alumina structure by X-ray diffraction may not appear.

As mentioned above, by the method described in Japanese Patent Publication No. 13768/1976 and U.S. Pat. No. 4,101,615, there are produced alumina-silica fibers which are 0.6 to 400 μm in diameter, 10 to 30 t/cm$^2$ in tensile strength, 1000 to 3000 t/cm$^2$ in modulus of elasticity and stable at above 1000° C. for a long time in air. These fibers are most suitable for use in this invention.

The silicon carbide fiber includes all the following fibers produced by known methods:

(1) silicon carbide/tungsten fibers;

(2) silicon carbide/boron/tungsten fibers (Borsic fibers); (the fibers (1) and (2) are a multi-phase composite fiber and are produced by the well-known gas-phase reaction method)

(3) silicon carbide/carbon fibers produced by coating a carbon fiber with an organosilicon polymer compound, followed by calcination in a non-oxidative atmosphere as disclosed in Japanese Patent Publication (unexamined) Nos. 6714/1977 and 91917/1977 (the fiber (3) is a multi-phase composite fiber);

(4) β-type SiC polycrystalline fibers produced by melt spinning of an organosilicon compound such as polycarbosilane, followed by heat treatment up to 1300° C. in vacuum or inert gas as disclosed in S. Yajima et al. [Chemistry Letters, pp 931–934, 1975, and Japanese Patent Publication (unexamined) No. 139929/1976]; and (5) Silicon carbide whiskers produced by the gas-phase reaction, provided that their composition near the surface is free carbon-containing SiC.

Among them, the silicon carbide fiber (4) is particularly suitable, like the foregoing alumina-silica fibers, for the production of fiber-reinforced metal composite materials, since it has the following properties as reported by J. Tanaka, Kagaku Keizai, December issue, pp 1–6, 1976; diameter, 8–12 μm; tensile strength, as high as 25–45 t/cm$^2$; modulus of elasticity, as high as 1800–3000 t/cm$^2$; density, as low as 2.8 g/cm$^3$; and it has a long fiber form.

SiC fibers produced by calcination of organosilicon polymers including polycarbosilane, however, necessarily contain free carbon from the synthetic point of view. The content of this free carbon is within the range of 0.01 to 40% by weight, as reported by Dr. Yajima et al. in Japanese Patent Publication (unexamined) No. 30407/1978. In the present invention, the interfacial reaction at the fiber/matrix is important, and hence, the content of free carbon at around surface of SiC fiber should be not less than 1% by weight. Accordingly, SiC fibers containing 1 to 40% by weight of free carbon and not more than 99% by weight of SiC are useful.

Consequently, the free carbon in SiC fibers reacts with the metal matrix to form a carbide, which has led to a fatal drawback of FRM, that is, "reduction in the mechanical strength of silicon carbide fibers as well as gradual change in the composition and mechanical strength of the matrix itself and, particularly, increase in brittleness" [cf. Japanese Patent Publication (unexamined) No. 30407/1978].

As a result of the inventors' extensive study on this point, it has been found that although the presence of the free carbon becomes surely a problem in reinforcement of aluminum and magnesium metals, it can be turned to favorable use, if the matrix is properly selected so as to obtain a moderate bonding strength at the fiber/matrix metal interface, and further that although FRM obtained is disadvantageous to some extent in weight reduction in comparison with aluminum or magnesium matrix, its strength can markedly be improved as described hereinafter.

The fibers may be used in the form of continuous or long fibers which have usually a length of about several centimeters to several tens of meters or longer, or in the form of short fibres which have usually a length of about one millimeter to several tens of millimeters.

In the use of short fibers, however, an aspect ratio (a ratio of fiber length to fiber diameter) should be not less than 10, preferably not less than 50, from the standpoint of the composite-strength theory.

The number of filaments in the fiber bundle is not particularly limited, but any number within the range of 1 (monofilament) to 200,000 (as observed in carbon fibers) is applicable in the present invention. According to the inventors' investigation, however, the number of filaments of less than 30,000 in fiber bundle is particularly effective in order to achieve that uniform infiltration of matrix between fibers.

Next, reference will be made to the matrix metal used in the present invention. As described above, a matrix metal alloy containing at least Zn and Al, or Zn and Mg is satisfactory for an inorganic fiber containing at least two components ($f_1$ and $f_2$).

An optimum Zn/Al or Zn/Mg content ratio depends upon the bonding strength at the fiber/matrix metal interface, and therefore, it varies naturally with the kind of inorganic fiber to be used together. This ratio is Zn: 10% by weight or more—Al or Mg: 90% by weight or less, preferably Zn: 30% by weight or more—Al or Mg: 70% by weight or less, in view of flexural strength. Maximum amount of Zn is 97% by weight, preferably 93% by weight.

It was confirmed by the inventors that, when the alumina-silica fiber having an $Al_2O_3$ content of 72 to 98% by weight and $SiO_2$ content of 2 to 28% by weight is, for example, used, a matrix alloy, as composed mainly of not less than 35%, preferably 35 to 93% by weight of Zn and not more than 65%, preferably 7 to 65% by weight of Al, is preferred in order to provide FRM having a flexural strength as high as more than 120 kg/mm$^2$. (The value "120 kg/mm$^2$" was employed as one standard which indicates that the yield strength of FRM obtained fills a gap between those of refined high tensile steel and super higher tensile steel)

It was further confirmed that, when the reinforcing material is a silicon carbide fiber containing not more than 99% by weight of SiC and 1 to 40% by weight of free carbon, a matrix alloy, as composed mainly of not less than 45%, preferably 45 to 93% by weight of Zn and not more than 55%, preferably 7 to 55% by weight of Al, provides FRM having a flexural strength as high as more than 120 kg/mm$^2$.

By the way, an alloy of Zn (78 wt.%)—Al(22 wt.%) has an eutectoid structure and its melting point is from 420° C. to 500° C. By rapidly cooling the alloy from the temperature just over the eutectic point (275° C.), there is provided a microstructure consisting of extremely fine grains. Accordingly, the alloy shows 1,000–2,0000% of elongation at a low strain-rate condition in the vicinity of eutectic point (270°–275° C.), that is so called superplasticity. This phenomenon is also observed at about 150° C. and the alloy shows comparatively large elongation. Consequently, composite material of Zn(78 wt.%)—Al(22wt.%) alloy has the drawback that there is a probability of troubles such as deformation of products due to superplasticity, when it is used under the condition of such a temperature hysteresis. As other superplastic alloys, there are known Zn(95 wt.%)—Al(5 wt.%) and Zn(60 wt.%)—Al (40 wt.%), and it is disclosed in Japanese Patent Publication (unexamined) No. 16636/1981 that alumina-base fiber-reinforced metallic composite material is prepared by using these superplastic alloys as the matrix.

As a result, in case of the Zn-Al matrix in this invention the ranges of Zn(94 to 96% by weight)—Al(4 to 6% by weight), Zn(77 to 79% by weight)—Al(21 to 23% by weight) and Zn(59 to 61% by weight)—Al(39 to 41% by weight) are excluded from the matrix composition from the practical view points, because the superplasticity tends to appear in the said range.

When the foregoing alumina-silica fiber having an $Al_2O_3$ content of 72 to 98% by weight and $SiO_2$ content of 2 to 28% by weight is used, a matrix alloy comprising not less than 34% by weight, preferably 34 to 95% by weight of Zn and not more than 66% by weight, preferably 5 to 66% by weight of Mg is preferred in order to provide FRM having a high flexural strength as more than 120 kg/mm$^2$.

When the foregoing silicon carbide fiber having an SiC content of not more than 99% by weight and a carbon content of 1 to 40% by weight, a matrix alloy comprising from about 40 to 90% by weight of Zn and from about 10 to 60% by weight of Mg may be preferred in order to provide FRM having a high flexural strength.

Addition of other element such as barium, bismuth and tin in the total amount of not more than 5% by weight to the matrix metal composed mainly of zinc and aluminum, or zinc and magnesium, does not damage the effect of the present invention, but rather is effective for the improvement of wettability between fiber and matrix metal in the case of the liquid-phase processes such as liquid metal infiltration, and therefore, it provides an advantage that pressure to be applied can be decreased in commercial production.

For producing the fiber- or whisker-reinforced metal composite materials of the present invention, all the well-known methods so far proposed to produce FRM may be used. The major methods of these are (1) liquid-phase processes such as liquid metal infiltration, (2) solid-phase processes such as diffusion bonding, (3) powder metallurgy (sintering, welding), (4) deposition processes such as plasma spraying, electrodeposition, chemical vapor deposition and etc., and (5) plastic processings such as extrusion, rolling and etc.

In the composite materials of the present invention, their strength and modulus of elasticity show a desirable tendency to increase with increase of the fiber volume fraction of the component inorganic fiber, i.e., the alumina-silica fiber or silicon carbide fiber. But, it was found that the upper limit of this volume fraction is 68% for composite materials having a unidirectional arrangement of continuous fibers or long fibers, and 53% for those having a random arrangement of short fibers, by the reason that when the fraction beyonds these upper limits it shows a tendendcy to decrease the tensile strength and flexural strength. Thus, the volume fraction (volume ratio) of the inorganic fibers in the composite material is usually in the range of 15 to 60% by volume in case of continuous or long fibers and in the range of 5 to 45% by volume in case of short fibers.

As described above, the present invention can provide a fiber-reinforced metal composite material greatly improved in the mechanical properties such as strength, modulus of elasticity and fatique strength, and thereby, extended use of the articles is expected, for example, in the fields of structural materials and machine parts. Such an improvement is owing to the high tensile strength such as about 150 to 450 kg/mm$^2$ of the inorganic fibers, particularly alumina-silica fibers and silicon carbide fibers, though the matrix metals have merely a tensile strength of at least about 10 to 30 kg/mm$^2$. The reinforcement rate of FRM depends upon the form of inorganic fibers, degree of orientation and fiber content, and the strength of FRM can generally be increased to more than about ten and several times as large as that of the original matrix metal. Furthermore, in case of in organic fiber-reinforced Zn/Al or Zn/Mg alloys, the bonding strength at the fiber/matrix metal interface is controlled to an optimum degree as compared with other FRM, and therefore, they have a high reinforcement rate and maintain thermal resistance over a wide range of from a low temperature to a high temperature as compared with resin composite materials. Thus, novel metallic articles having excellent properties can be obtained by the method of the present invention.

The present invention will be illustrated in more detail with reference to the following examples, which are not however to be interpreted as limiting the invention thereto.

EXAMPLE 1

A bundle of continuous alumina-silica fibers ($Al_2O_3$, 85 wt.%; $SiO_2$, 15 wt.%) composed of 200 filaments having an average diameter of 15 μm, a density of 3.05 g/cm$^3$, a tensile strength of 20.7 t/cm$^2$ (gauge length, 20 mm) and a modulus of elasticity of 2350 t/cm$^2$, was inserted into a mold in the lengthwise direction so that the volume fraction of fiber was 50%. Thereafter, the mold was heated while sucking air from one end, and at the other end, a Zn(80 wt.%)/Al(20 wt.%) alloy, (molten at 540° C.) was allowed to infiltrate into the bundle under argon pressure. As a result, there was obtained an alumina-silica fiber reinforced Zn/Al alloy composite material having a length of 110 mm, a width of 20 mm and a thickness of 2.1 mm.

The mechanical test of this formed product was carried out at room temperature. As a result, the product showed tensile strength, 101–116 kg/mm$^2$; flexural strength, 153–172 kg/mm$^2$; and Young's modulus, 1.3–1.5×10$^4$ kg/mm$^2$. For comparison purpose, the original matrix metal without reinforcement with fiber was subjected to the tension test likewise. The test result showed that the tensile strength was 22 kg/mm$^2$ and Young's modulus was 0.88×10$^4$ kg/mm$^2$. Thus, the mechanical properties of the matrix metal were remarkably improved by reinforcement with alumina-silica fibers.

A sample for fatigue strength test was cut off from the remainder of the formed product and tested on Servopulser EHF-5 (producted by Shimadzu Co.) under the following conditions: test temperature, 25° C.; repeated frequency, 30 Hz; and output wave by load control, a sine wave. By changing the amplitude of repeated stress (S), the number of repeated times (N) until fatigue fracture was measured to obtain a S-N curve. As a result, it was found that a stress on fatigue fracture at N=10$^7$ showed as very high a value as 69 to 73% of the static tensile strength, which is a characteristic never observable with other metal alloys.

Figure 2A:
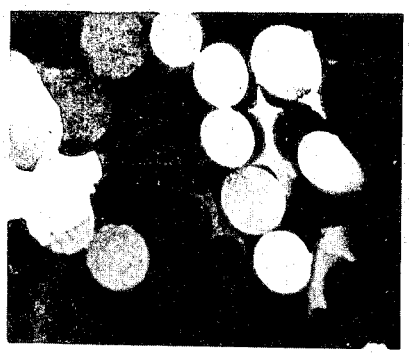
FIGS. 2(*a*)–(*c*) are electron microscope photographs of the flexural-fracture surfaces of composite materials.
Figure 2B:
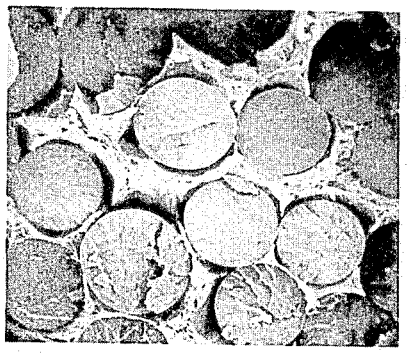
Figure 2C:
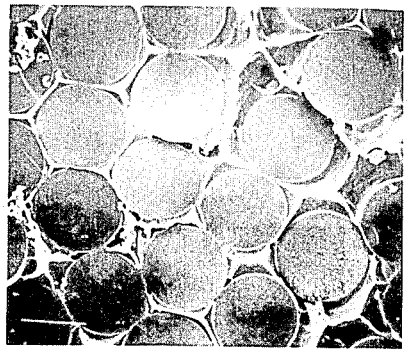

By electron microscopic observation of the flexural-fracture surface (surface revealed by fracture by bending) of the composite materials obtained from the alumina-silica fiber and Zn/Al alloy matrix, it was confirmed that the fibers in the matrix were uniformly distributed as shown in FIG. 2(*b*).

EXAMPLE 2

In the same manner as in Example 1, composite materials of the alumina-silica fiber with matrix metals, Zn(100), Zn(90)/Al(10), Zn(60)/Al(40), Zn(35)/Al(65), Zn(20)/Al(80), Zn(10)/Al(90) and Al(100), were produced under the following conditions;

Infiltration temperature: (temperature at which each matrix metal turns liquid)+40° C.

Infiltration pressure: 50 kg/cm$^2$

Fiber volume fraction: 49±2%. In the present invention, Zn(100) and Al(100) refer to Zn(99.9 wt.%) and Al(99.9995 wt.%), respectively, as a result of chemical analysis.

A bending test was carried out at room temperature using 10 test pieces for each sample thus obtained. A curve (1) in FIG. 1 was obtained by plotting the range of flexural strength obtained against the Al content (wt.% W, at % w) of the matrix. This curve shows that the range of flexural strength above 120 kg/mm$^2$ is present in the region wherein the Al content is not more than 65 wt.%.

As typical examples, the bend-fracture surface of FRMs obtained by composite fabrication with Zn(100) and Al(100) matrixes was shown in FIGS. 2(*a*) and 2(*c*), respectively. By electron microscopic observation of the surface, the followings are found: With the Zn(80)/Al(20) matrix [refer to FIG. 2(*b*)], the bend-fracture surface shows no pull-out of fiber [as shown in FIG. 2(*a*)] nor generation of planar cracks [as shown in FIG. 2(*c*)], which means that the bonding strength at the fiber/matrix metal interface is controlled neither too strong nor too weak but to an optimum degree.

Although the composite material of the alumina-silica fiber with the matrix metal: Zn(60)/Al(40) shows excellent flexural strength under the present condition (room temperature) as mentioned above, it shows superplasticity at higher temperature, and hence, it is excluded from the present invention.

EXAMPLE 3

A bundle of continuous silicon carbide fibers (SiC, 50 wt.%; C, 35 wt.%; the remainder, $SiO_2$) having an average diameter of 15 μm, density of 2.8 g/cm$^3$ and a tensile strength of 22.7 t/cm$^2$ (gauge length, 20 μmm), as produced from polycarbosilane, was combined with the following Zn/Al matrix alloys in the same manner as in Example 1: Zn(100), Zn(90)/Al(10), Zn(80)/Al(20), Zn(50)/Al(50), Zn(35)/Al(65), Zn(15)/Al(85) and Al(100). The temperature and pressure on infiltration were the same as in Examples 1 and 2, and the fiber volume fraction was 50±1%. A bending test was carried out at room temperature using 5 test pieces for each sample thus obtained. A curve (2) in FIG. 1 was obtained by plotting the range of flexural strength obtained against the Al content (wt.% W, at % w) of the matrix. This curve shows that the range of flexural strength above 120 kg/mm$^2$ is present in the region wherein the Al content is 3 to 55 wt.%.

Figure 3A:
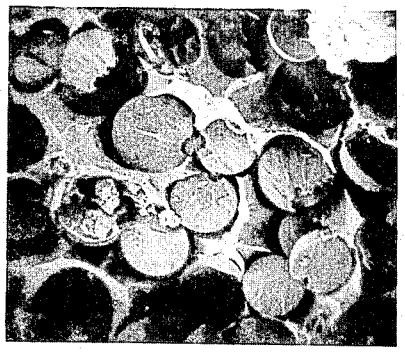
FIGS. 3(*a*)–(*c*) are electron microscope photographs of the flexural-fracture surfaces of composite materials with Zn(100), Zn(80)/Al(20) and Al(100) matrix, respectively.
Figure 3B:
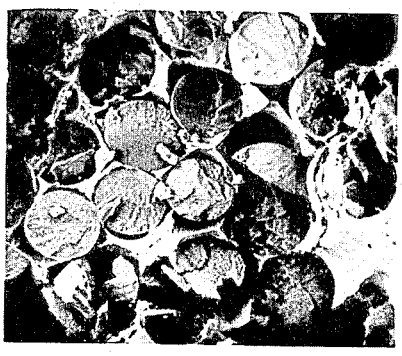
Figure 3C:
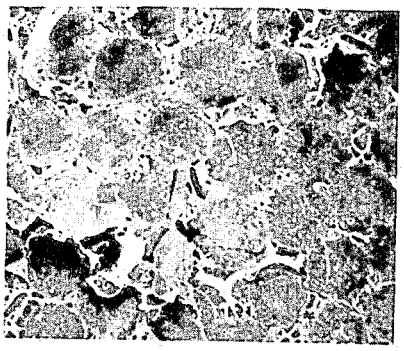

As typical examples, the flexural-fracture surface of FRMs obtained by composite fabrication of the silicon carbide fiber with Zn(100), Zn(80)/Al(20) and Al(100) matrix metals was shown in FIGS. 3(*a*), 3(*b*) and 3(*c*), respectively. The symbols (a), (b) and (c) have the same meaning as the same symbols in FIG. 2. By observation of the surface, the followings are found: With Al(100) matrix, the progress of reaction between fiber and matrix metal is so remarkable that the fiber/matrix metal interface is vague, and with Zn(100) matrix, pull-out of fiber is observed; while with Zn(80)/Al(20) matrix providing the highest strength, the bonding strength at the fiber/matrix metal interface is controlled to an optimum degree.

EXAMPLE 4

Two kinds of silicon carbide fibers (average fiber diameter: each 15 μm) containing different content of free carbon are produced by subjecting polycarbosilane to melt-spinning, non-melting treatment, and then calcining with controlling the conditions in heat treatment up to 1300° C. The SiC/C (wt.%/wt.%) of these fibers are found to be 45/40 and 70/5, respectively (the balance is $SiO_2$) by chemical analysis. In the same manner as described in the example 1, two kinds of silicon carbide fiber-reinforced Zn(80 wt.%)—Al(20 wt.%) matrix alloy composite are obtained. The volume fractions of fibers are in the range of 50±2%. The flexural strength test of these products is carried out at room temperature by using 5 test pieces of each sample. The results (average data) are shown in table 1 with one of the test results of Example 3 (SiC/C: 50/35). The flexural strength of FRM produced exceeds 120 kg/mm$^2$, when SiC/C weight content of fibers is in the range as aforesaid.

TABLE 1

| No. | Fiber composition SiC/C (wt. %/wt. %) | Flexural strength of FRM (Kg/mm$^2$) |
|---|---|---|
| 1 | 45/40 | 140 |
| 2* | 50/35 | 151 |
| 3 | 70/5 | 123 |

*The same fiber as shown in the example 3

EXAMPLE 5

In the same manner as in Example 1, composite materials of the alumina silica fiber with matrix metals, Zn(90)/Mg(10), Zn(70)/Mg(30), Zn(50)/Mg(50), Zn(35)/Mg(65), Zn(10)/Mg(90) and Mg(100) were produced under the following conditions, where the purity of Mg exhibited by Mg(100) was 99.9 wt.%;

Infiltration temperature: (temperature at which each matrix turns liquid)+40° C.

Infiltration pressure: 50 Kg/cm$^2$

Fiber volume fraction: 50±2%

Figure 4:
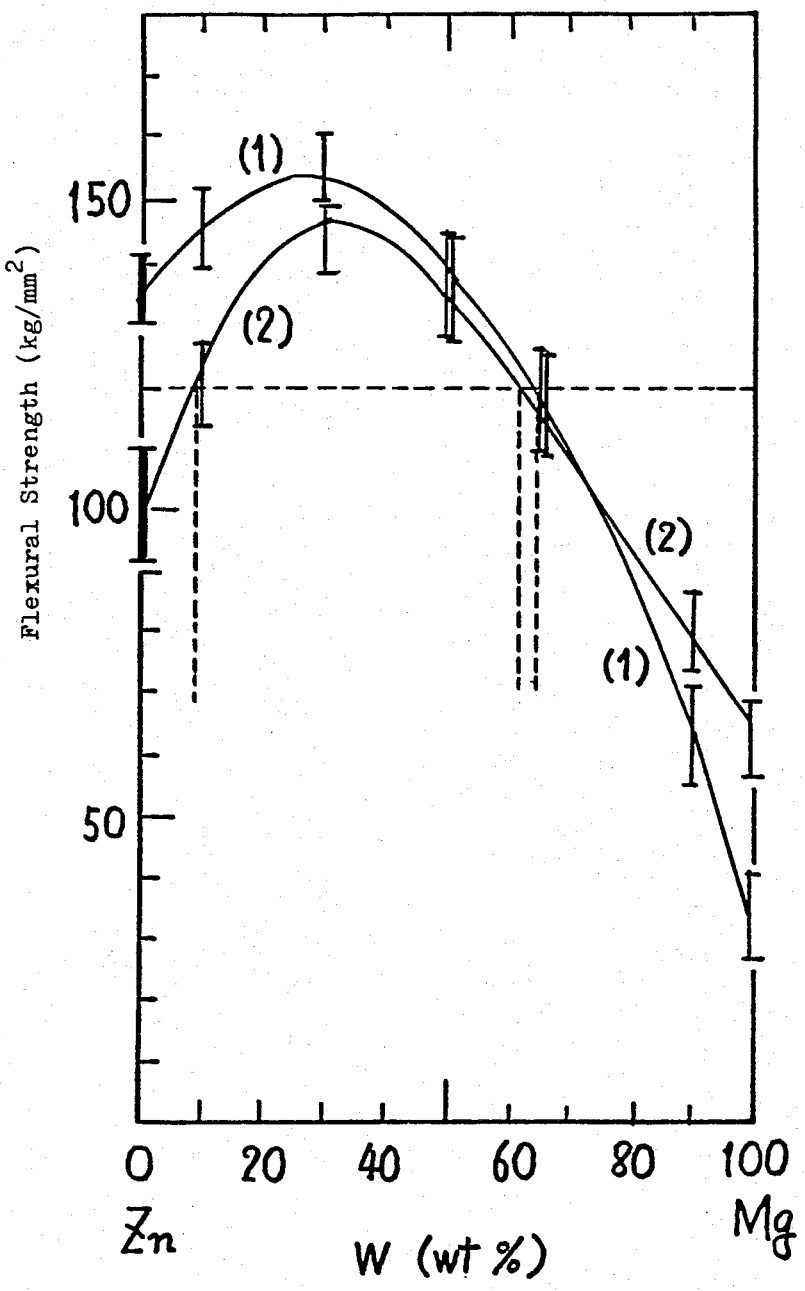
FIG. 4 is a plotting of the results of a bending test plotting the range of flexural strength versus aluminum content of the matrix.

A bending test was carried out at room temperature by using 10 test pieces for each sample thus obtained. The curve in FIG. 4 was obtained by plotting the range of flexural strength obtained against the Mg content (wt.% W) of the matrix. The curve is the case of composite materials of the alumina-silica fiber with Zn/Mg alloy. The curve shows that the range of flexural strength above 120 kg/mm$^2$ is in the region wherein the Zn content is not less than 34 wt.% for alumina-silica fiber.

What is claimed is:

1. A fiber-reinforced metal composite material consisting essentially of a reinforcing material and matrix, said reinforcing material being an inorganic fiber containing at least two components selected from the group consisting of carbon, metal oxides, metal carbides, metal nitrides and metal borides, and said matrix being metal alloys comprising not less than 10% by weight of zinc and not more than 90% by weight of one element selected from the group consisting of aluminum and magnesium, provided that a metal alloy containing 94 to 96% by weight of zinc and 4 to 6% by weight of aluminum, a metal alloy containing 77 to 79% by weight of zinc and 21 to 23% by weight of aluminum, and a metal alloy containing 59 to 61% by weight of zinc and 39 to 41% by weight of aluminum are excluded.

2. A fiber-reinforced metal composite material as claimed in claim 1, wherein the composite material has a flexural strength of 120 kg/mm$^2$ or more.

3. A fiber-reinforced metal composite material according to claim 1, wherein the reinforcing material is alumina-silica fibers containing 72 to 98% by weight of $Al_2O_3$ and 2 to 28% by weight of $SiO_2$ and exhibiting substantially no reflection due to the $\alpha$-$Al_2O_3$ structure by X-ray diffraction, and the matrix is a metal alloy containing not less than 35% by weight of zinc and not more than 65% by weight of aluminum.

4. A fiber-reinforced metal composite material according to claim 1, wherein the reinforcing material is silicon carbide fibers containing not more than 99% by weight of SiC and 1 to 40% by weight of carbon and the matrix is a metal alloy containing not less than 45% by weight of zinc and not more than 55% by weight of aluminum.

5. A fiber-reinforced metal composite material according to claim 1, wherein the reinforcing material is alumina-silica fibers containing 72 to 98% by weight of $Al_2O_3$ and 2 to 28% by weight of $SiO_2$ and exhibiting substantially no reflection due to the $\alpha$-$Al_2O_3$ structure by X-ray diffraction, and the matrix is a metal alloy containing not less than 34% by weight of zinc and not more than 66% by weight of magnesium as main components.

6. A fiber-reinforced metal composite material according to claim 1, wherein the reinforcing material is silicon carbide fibers containing not more than 99% by weight of SiC and 1 to 40% by weight of free carbon, and the matrix is a metal alloy containing 40 to 90% by weight of zinc and 10 to 60% by weight of magnesium.

7. A fiber reinforced metal composite material according to claim 3, wherein said $SiO_2$ is replaced by not more than 10 wt. % based on the total weight of said fiber of an oxide of at least one of the elements selected from the group consisting of lithium, beryllium, boron, sodium, magnesium, phosphorous, potassium, calcium, titanium, chromium, manganese, yttrium, zirconium, lanthanum, tungsten and barium.

8. A fiber-reinforced metal composite material according to claim 1, wherein the reinforcing material is alumina-silica fibers containing 72 to 98% by weight of $Al_2O_3$ and 2 to 28% by weight of $SiO_2$ and exhibiting substantially no reflection due to the $\alpha$-$Al_2O_3$ structure by X-ray diffraction, and the matrix is a metal alloy containing not less than 35% by weight of zinc and not more than 65% by weight of aluminum as main components.

9. A fiber-reinforced metal composite material according to claim 1, wherein the reinforcing material is silicon carbide fibers containing not more than 99% by weight of SiC and 1 to 40% by weight of free carbon, and the matrix is a metal alloy containing 45 to 93% by weight of zinc and 7 to 55% by weight of aluminum.

* * * * *